US007326092B2

(12) United States Patent
Fedder et al.

(10) Patent No.: US 7,326,092 B2
(45) Date of Patent: Feb. 5, 2008

(54) DOUBLE ENDED GUIDE PIN ASSEMBLY

(75) Inventors: James Lee Fedder, Etters, PA (US); Robert Charles Trea, Harrisburg, PA (US); Gregory Gordon Griffith, Carlisle, PA (US)

(73) Assignee: Tyco Electronics Corporation, Middletown, PA (US)

( * ) Notice: Subject to any disclaimer, the term of this patent is extended or adjusted under 35 U.S.C. 154(b) by 66 days.

(21) Appl. No.: 11/201,980

(22) Filed: Aug. 11, 2005

(65) Prior Publication Data

US 2007/0037434 A1 Feb. 15, 2007

(51) Int. Cl.
*H01R 13/64* (2006.01)

(52) U.S. Cl. ..... 439/681; 361/756

(58) Field of Classification Search ..... 439/677, 439/678, 680, 681; 361/756
See application file for complete search history.

(56) References Cited

U.S. PATENT DOCUMENTS 3,643,204 A 2/1972 Drenten
4,519,667 A * 5/1985 Canning et al. ..... 439/681
4,568,134 A 2/1986 HDiMondi
4,776,811 A 10/1988 Humphrey
4,895,535 A * 1/1990 Emadi et al. ..... 439/681
4,934,950 A * 6/1990 Green et al. ..... 439/681
4,998,892 A 3/1991 Shiley
5,032,088 A 7/1991 Kuramitsu
5,125,849 A 6/1992 Briggs et al.
5,391,091 A * 2/1995 Nations ..... 439/378
5,575,686 A * 11/1996 Noschese ..... 439/620
5,833,472 A * 11/1998 Bright ..... 439/70
6,059,600 A 5/2000 Vanbesien

OTHER PUBLICATIONS

U.S. Appl. No. 10/832,548, filed Apr. 28, 2004, Morana.

* cited by examiner

*Primary Examiner*—Thanh-Tam Le

(57) ABSTRACT

A double ended guide pin assembly includes a first guide pin body having a first rotation axis and a first keying surface. A second guide pin body has a second rotation axis and a second keying surface. A fastener element connects the first guide pin body to the second guide pin body such that the first and second guide pin bodies are independently rotatable on the first and second rotation axes, respectively. The first and second keying surfaces are selectively positionable at different orientations with respect to each other.

20 Claims, 4 Drawing Sheets

DOUBLE ENDED GUIDE PIN ASSEMBLY

BACKGROUND OF THE INVENTION

The invention relates generally to circuit board connectors and, more particularly, to a double ended guide pin assembly for mechanically interconnecting circuit boards.

At least some electronic systems, such as some computer systems, and in particular, rack and panel computer systems, include a primary circuit board, such as a backplane board or card, connected to one or more peripheral circuit boards, called daughter cards. In order to save space on the circuit boards, it is common to mount the backplane boards and daughter cards at a right angle to each other. Electrical connectors establish electrical communication between various daughter cards via a backplane card. Typically, one or more guide pins are used to mechanically link the circuit boards together. The guide pins provide preliminary alignment or preliminary guidance between the circuit boards so the circuit boards are positioned to facilitate proper mating of the electrical connectors. The guide pins may also provide load carrying capability between the circuit boards as well as keying and electrostatic discharge (ESD) protection.

In another technique for saving board space, a feed-through type connector is used to mount components to both sides of the circuit board. In a feed-through connection, alignment of the components must be addressed on both sides of the circuit board. In at least some double ended guide pin designs, the guide pin includes multiple components and are prone to misalignment between the ends of the guide pins on opposite sides of the circuit board. Additionally, such guide pins typically do not provide keying capabilities on both sides of the circuit board.

A need remains for a double ended guide pin that addresses the above mentioned shortcomings as well as other concerns in the prior art.

BRIEF DESCRIPTION OF THE INVENTION

In one aspect of the invention, a double ended guide pin assembly is provided. The guide pin assembly includes a first guide pin body having a first rotation axis and a first keying surface. A second guide pin body has a second rotation axis and a second keying surface. A fastener element connects the first guide pin body to the second guide pin body such that the first and second guide pin bodies are independently rotatable on the first and second rotation axes, respectively. The first and second keying surfaces are selectively positionable at different orientations with respect to each other.

Optionally, the first guide pin body includes an elongated shaft extending along a longitudinal axis between a tapered end and a base. The first guide pin body also includes a threaded channel sized to receive an end of the fastener, and the shaft includes the first keying surface. The second guide pin body includes an elongated shaft extending along a longitudinal axis between a first end and a base. The second guide pin body further includes a through hole extending along the longitudinal axis, and the shaft includes the second keying surface. The first guide pin body and the second guide pin body each includes a base having a base ring and a keying boss. Each keying boss includes a keying protrusion and at least one centering rib.

In another aspect, a double ended guide pin assembly is provided that includes a first guide pin body having a first rotation axis and a first keying surface and a second guide pin body having a second rotation axis and a second keying surface. A fastener element connects the first guide pin body to the second guide pin body such that the first and second guide pin bodies are independently rotatable on the first and second rotation axes, respectively. The first and second keying surfaces are selectively positionable at different orientations with respect to each other. The first guide pin body and the second guide pin body include a space therebetween when joined. The space is variable within a range between a predetermined minimum space and a predetermined maximum space.

DETAILED DESCRIPTION OF THE INVENTION

Figure 1:
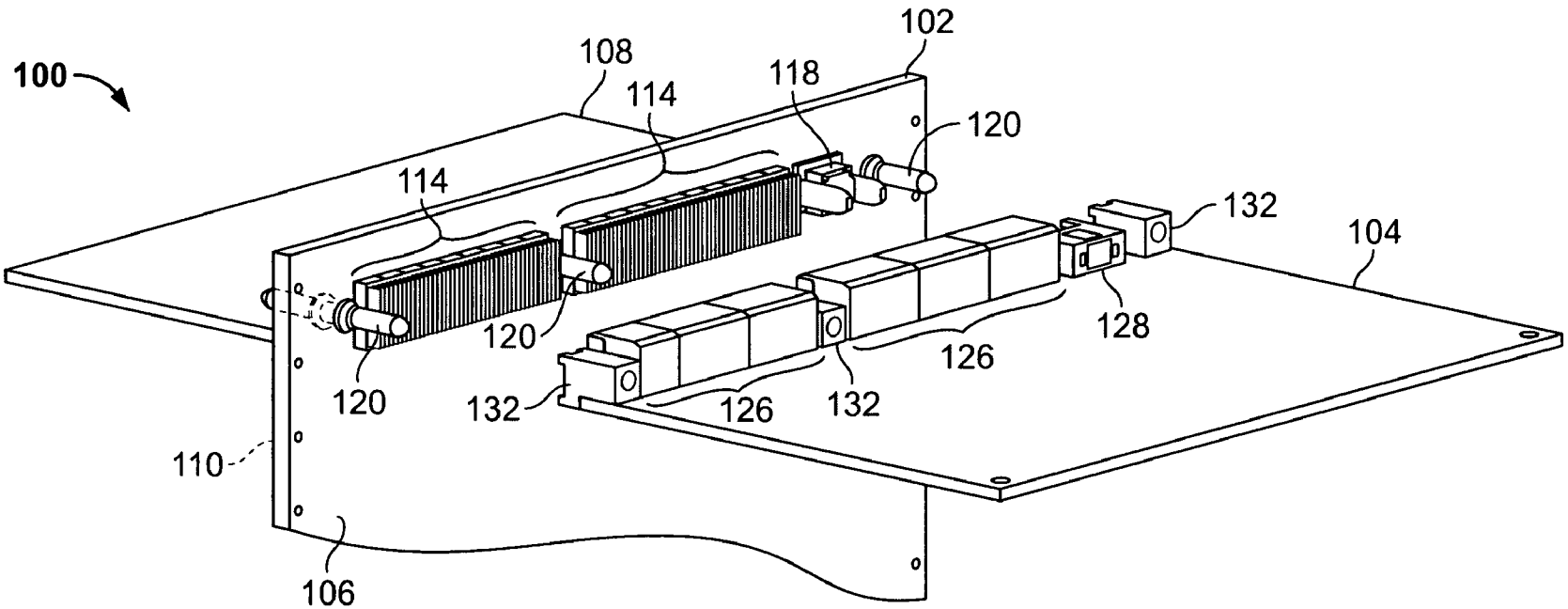
FIG. 1 is a perspective view of a circuit board assembly in accordance with an embodiment of the present invention.

FIG. 1 illustrates a circuit board assembly 100 formed in accordance with an exemplary embodiment of the present invention. The assembly 100 includes a backplane board 102, a first daughter card, or daughter board 104, connected to a first side 106 of the backplane board 102 and a second daughter card 108 connected to a second side 110 of the backplane board 102.

The backplane board 102 includes a number of the electrical connectors 114 that may be feed-through connectors that electrically connect circuits on the first daughter card 104 to circuits on the second daughter card 108. The backplane board 102 may also include electrical modules 118 that may be connected to one or both of the daughter cards 104 and 108. The backplane board 102 also includes a number of double ended guide pins 120 that are used in mechanically connecting the daughter cards 104 and 108 to the backplane board 102 as will be described.

The daughter card 104 includes connectors 126 that are configured to mate with the connectors 114 on the backplane board 102. An electronic component 128 is configured to mate with the module 118. A number of keying guide modules 132 are provided on the daughter card 104 that are configured to receive the guide pins 120 on the backplane board 102. The guide pins 120 and the guide modules 132 cooperate to provide preliminary positioning and guidance to position the connectors 114 and 126 and the modules 118 and 128 for mating. In addition, the guide pin 120 and guide modules 132 cooperate to provide keying features and may provide protection from electrostatic discharge (ESD) when an ESD spring or other ESD shielding is provided.

The second daughter card 108 is configured similarly to the first daughter card 104 including connectors (not shown)

that electrically mate with connectors (not shown) on the second side 110 of the backplane board 102. The daughter card 108 also includes guide modules (not shown) that receive a second end (not shown) of the guide pins 120.

While the invention is herein described in the context two daughter cards connected to a backplane board to form a circuit board assembly, it is to be understood that other assemblies are contemplated between circuit boards or other components wherein the benefits of the invention may be appreciated. In particular, no limitation is intended in the particular arrangement or number of the guide pins used in the assembly or in the number, type, or arrangement of the electrical connectors or modules described herein.

Figure 2:
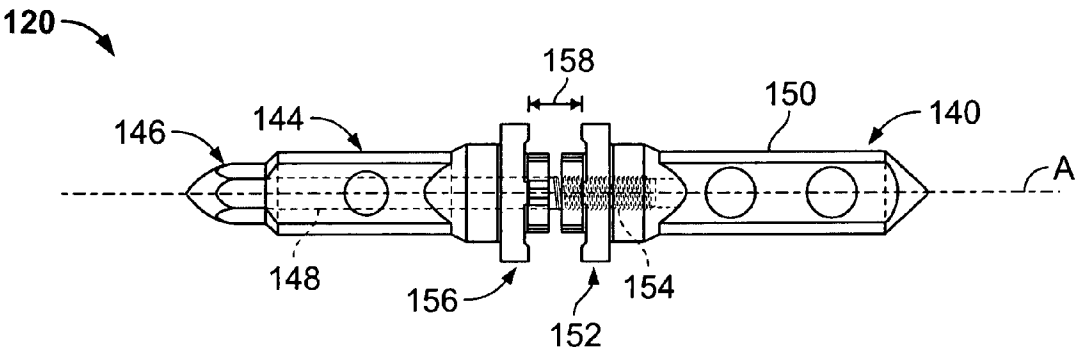
FIG. 2 is a side view of a guide pin assembly formed in accordance with an exemplary embodiment of the present invention.

FIG. 2 illustrates the guide pin assembly 120. The guide pin assembly 120 includes a first guide pin body 140, a second guide pin body 144, and a fastener 146. The fastener 146 joins the first guide pin body 140 and the second guide pin body 144 along a common longitudinal axis A. The second guide pin body 144 includes a through hole 148 shown in phantom outline. The through hole 148 extends along the longitudinal axis A. The first guide pin body 140 includes an elongated shaft 150 and a base 152. The base 152 includes a threaded channel 154 sized to receive a threaded end of the fastener 146. The second guide pin body 144 also includes a base 156. A space 158 between the base 152 and the base 156 is variable within a range to accommodate a thickness of a circuit board as will be described.

Figure 3:
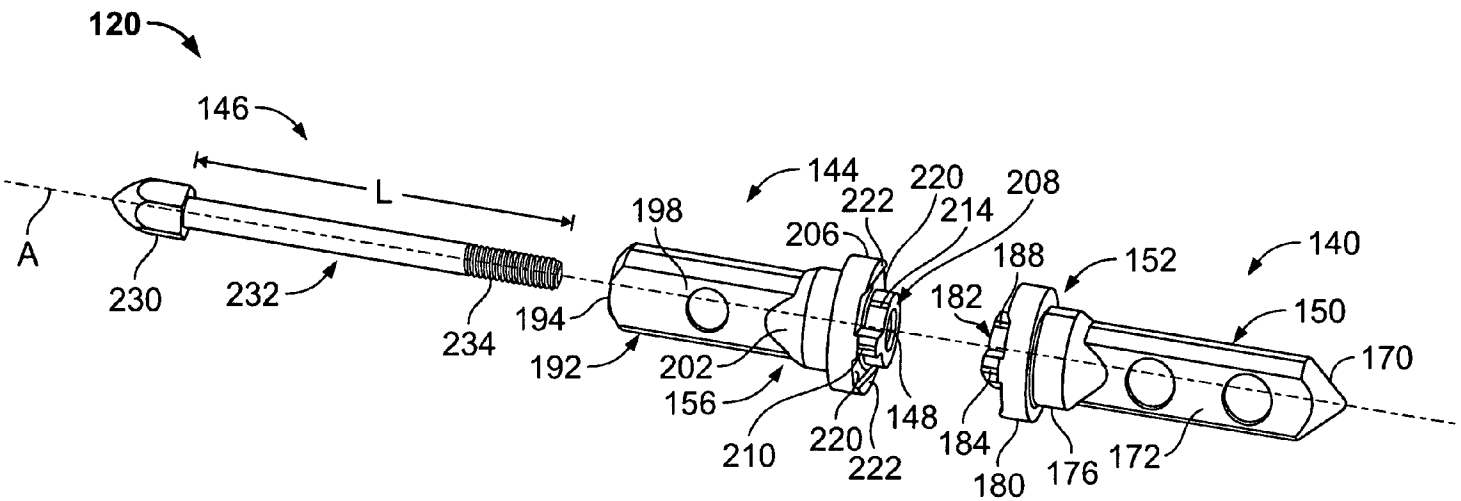
FIG. 3 is an exploded view of the guide pin assembly shown in FIG. 2.
Figure 4:
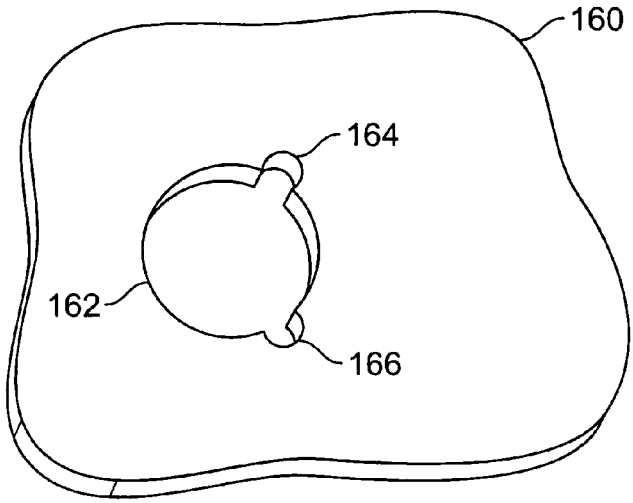
FIG. 4 is a partial view of a circuit board with a guide pin mounting hole.

FIG. 3 illustrates an exploded view of the guide pin assembly 120. FIG. 4 illustrates a portion of a circuit board 160 with which the guide pin assembly 120 may be used. The circuit board 160 includes a guide pin mounting hole 162 and keying apertures 164 and 166. The keying apertures 164, 166 may be positioned at any point on the perimeter of the mounting hole 162. In some embodiments, there may be only one keying aperture 164, 166. The first guide pin body 140 (FIG. 3) includes an elongated shaft 150 that extends along the longitudinal axis A between a tapered end 170 and the base 152. The shaft 150 includes a first keying surface 172. In an exemplary embodiment, the keying surface 172 is substantially flat. However, the keying surface 172 may be formed with other contours in other embodiments. The base 152 includes a transition region 176 that joins the shaft 150 to a base ring 180. A keying boss 182 extends from the base ring 180 opposite the transition region 176. The keying boss 182 includes a keying protrusion 184 and at least one centering rib 188 both of which are formed on a perimeter of the keying boss 182. The keying protrusion 184 is aligned with the first keying surface 172. The keying boss 182 is received in the guide pin mounting hole 162. The keying protrusion 184 is received in one of the keying apertures 164, 166. The keying protrusion 184 is complementary in shape to one of the keying apertures 164, 166 in the circuit board 160 in which the guide pin assembly 120 is mounted thereby orienting the first guide pin body 140 with respect to the circuit board 160. The keying protrusion 184 may have any geometry. The centering rib 188 is provided to center the first guide pin body 140 in the mounting hole 162 in the circuit board 160. The centering rib 188 also engages the circuit board material to assist in retaining the first guide pin body 140 in position in the circuit board 160.

The second guide pin body 144 includes an elongated shaft 192 that also extends along the longitudinal axis A. The elongated shaft 192 extends between a fastener receiving end 194 and the base 156 and includes the through hole 148. The shaft 192 includes a second keying surface 198. In an exemplary embodiment, the second keying surface 198 is substantially flat. However, the second keying surface 198 may be formed with other contours in other embodiments. The first and second guide pin bodies 140 and 144 are formed separate and distinct from one another, thereby enabling the first and second keying surfaces 172 and 198 to be rotated or adjusted with respect to one another and to be oriented independent from one another. That is, when installed in a circuit board, the first and second guide pin bodies 140 and 144 may be oriented at different predetermined positions about the axis A with respect to one another.

The base 156 includes a transition region 202 that joins the shaft 192 to a base ring 206. A keying boss 208 extends from the base ring 206 opposite the transition region 202. The keying boss 208 includes a keying protrusion 210 and at least one centering rib 214 both of which are formed on a perimeter of the keying boss 208. The keying protrusion 210 is aligned with the second keying surface 198. The keying boss 208 is received in the guide pin mounting hole 162 (FIG. 4). The keying protrusion 210 is received in one of the keying apertures 164, 166. The keying protrusion 210 is complementary in shape to the keying apertures 164, 166 in the circuit board 160, in which the guide pin assembly 120 is mounted, thereby orienting the second guide pin body 144 with respect to the circuit board 160. The keying protrusion 210 may have any geometry. The centering rib 214 is provided to center the second guide pin body 144 in the mounting hole 162 in the circuit board 160. The centering rib 214 also securely engages the circuit board material to assist in retaining the second guide pin body 144 in position in the circuit board 160. The first and second guide pin bodies 140 and 144 are joined to one another and oriented to extend along a common axis, namely longitudinal axis A. Before being secured in position, the first and second guide pin bodies 140 and 144 may be rotated with respect to one another about the longitudinal axis A.

The base 156 on the second guide pin body 144 includes undercut areas 220 which form standoffs 222 that rest on the circuit board 160 (FIG. 4) when the guide pin assembly 120 is installed in the circuit board 160. Similar undercut and standoff features are also formed on the base 152 of the first guide pin body 140.

The fastener 146 includes a tapered head 230 and a shaft portion 232 that includes a threaded end 234. The shaft portion 232 is received in the through hole 148 in the second guide pin body 144. The threaded end 234 engages threads in the threaded channel 154 of the first guide pin body 140 to join the first and second guide pin bodies 140 and 144 along the longitudinal axis A. The tapered head on the fastener 146 provides pickup capability, or initial guidance for the second guide pin body 144 when a daughter card is attached to the circuit board 160. Because the first and second guide pin bodies 140 and 144 are separable, independent keying of the first and second guide pin bodies 140 and 144 with respect to one another is achieved.

Figure 5:
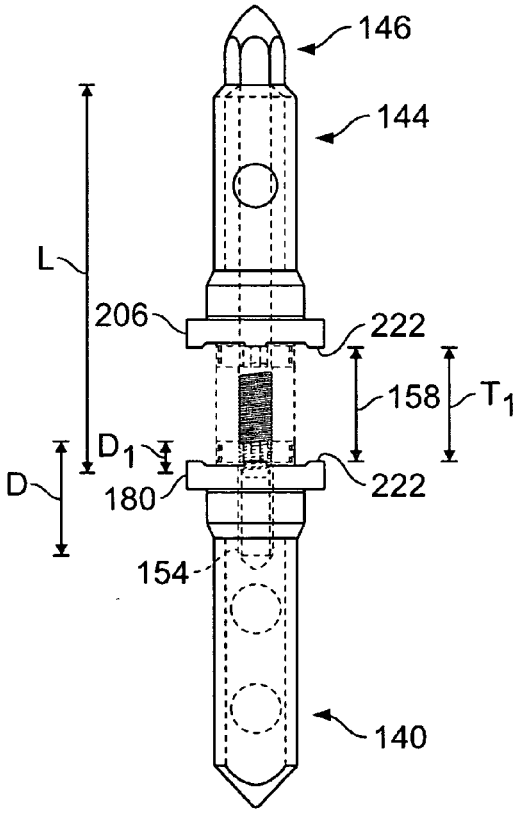
FIG. 5 is a side view of an exemplary guide pin assembly installed in a circuit board having a maximum thickness.
Figure 6:
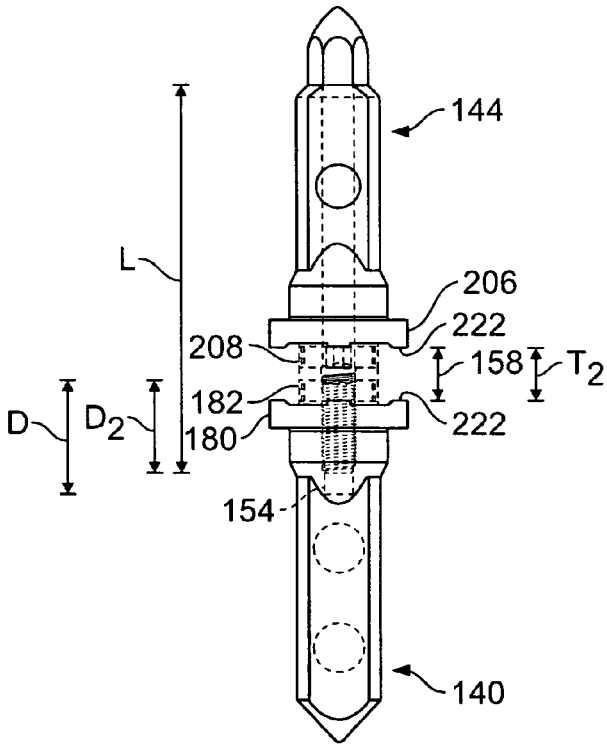
FIG. 6 is a side view of an exemplary guide pin assembly installed in a circuit board having a minimum thickness.

FIG. 5 illustrates a side view of the guide pin assembly 120 installed in a circuit board having a maximum allowable thickness $T_1$. FIG. 6 illustrates a side view of the guide pin assembly 120 installed in a circuit board having a minimum allowable thickness $T_2$. When installed in a circuit board, the guide pin assembly 120 includes a space 158 between the bases 152 and 156 of the first guide pin body 140 and the second guide pin body 144, respectively. The space 158 represents a distance between the standoffs 222 on the base rings 180 and 206 and is variable dependent upon the thickness of the circuit board. The space 158 corresponds to a circuit board thickness and is variable within a range from a predetermined maximum space, corresponding to a maximum circuit board thickness $T_2$, to a predetermined minimum space corresponding to a minimum circuit board thickness $T_2$. The first and second guide pin bodies 140 and 144 may therefore be separated from one another by different spacings between $T_1$, and $T_2$ along the axis A.

The space 158 is depicted in FIG. 5. Although the threaded end 234 of the fastener 146 extends only to a depth $D_1$ at the maximum circuit board thickness $T_1$, the depth D of the threaded channel 154 is established to receive the threaded end 234 of the fastener 146 at the minimum circuit board thickness $T_2$. The depth D of the threaded channel 154 is limited so that the first guide pin body 140 is not substantially weakened by the presence of the channel 154. The material from which the guide pin bodies 140 and 144 are fabricated can be selected to provide the needed strength or load carrying capacity. In one embodiment, the guide pin bodies 140 and 144 are fabricated from die cast zinc while the fastener 146 is fabricated from stainless steel. For added strength, one or both of the guide pin bodies 140, 144 may be fabricated from a material such as stainless steel. In an exemplary embodiment, the maximum space 158, or maximum circuit board thickness $T_1$ is about 7.5 millimeters.

The minimum space 158 is depicted in FIG. 6. The minimum allowable circuit board thickness $T_2$ is selected such that the keying boss 182 on the first guide pin body 140 and the keying boss 208 on the second guide pin body 144 do not interfere or abut one another. When the space 158 is at the minimum, or the circuit board has a minimum thickness $T_2$, the threaded end 234 of the fastener 146 is received a distance $D_2$ in the threaded channel 154. In an exemplary embodiment, the minimum space 158, or minimum circuit board thickness $T_2$ is about 3.6 millimeters.

Figure 7:
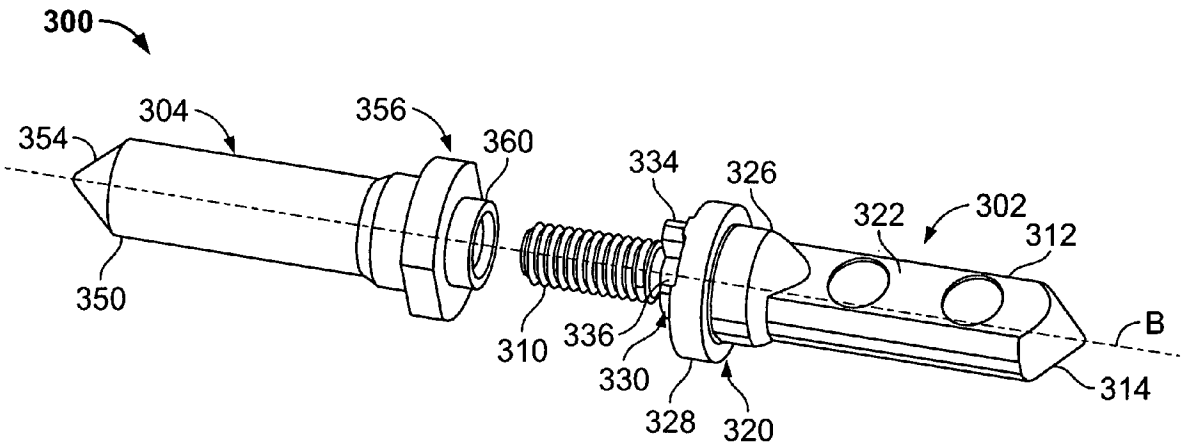
FIG. 7 is an exploded view of a guide pin assembly formed in accordance with a alternative embodiment of the present invention.
Figure 8:
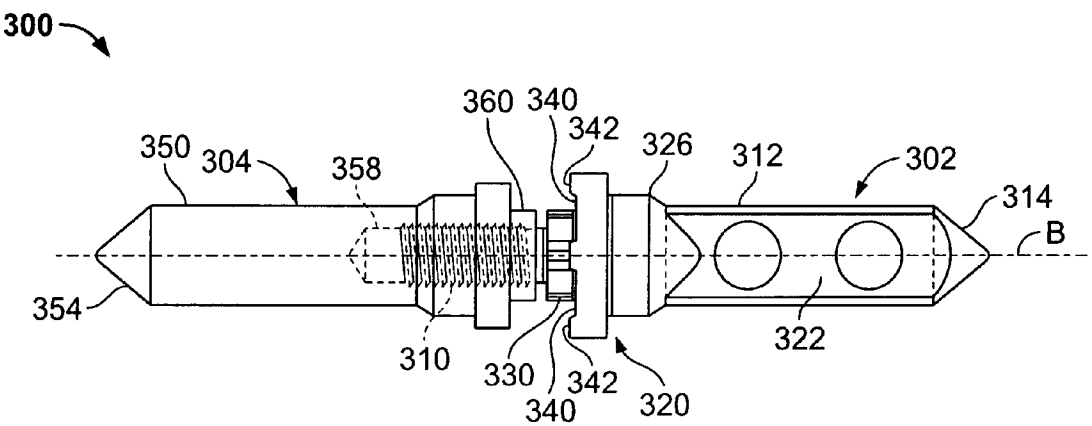
FIG. 8 is a side view of the assembled guide pin assembly shown in FIG. 7.

FIG. 7 is an exploded view of a guide pin assembly 300 formed in accordance with a alternative embodiment of the present invention. FIG. 8 is a side view of the assembled guide pin assembly 300. The assembly 300 includes a first guide pin body 302 and a second guide pin body 304. The first guide pin body 302 includes a threaded extension 310 that joins the first guide pin body 302 and the second guide pin body 304 along a longitudinal axis B. The first guide pin body 302 includes an elongated shaft 312 that extends along the longitudinal axis B between a tapered end 314 and a base 320. The shaft 312 includes a keying surface 322. In an exemplary embodiment, the keying surface 322 is substantially flat. However, the keying surface 322 may be formed with other contours in other embodiments. The base 320 includes a transition region 326 that joins the shaft 312 to a base ring 328 on the base 320. A keying boss 330 extends from the base ring 328 opposite the transition region 326. The keying boss 330 includes a keying protrusion 334 and at least one centering rib 336 both of which are formed on a perimeter of the keying boss 330. The keying protrusion 334 is aligned with the keying surface 322. The keying boss 330 is received in a guide pin mounting hole, such as the mounting hole 162 (FIG. 4) as previously described. The keying protrusion 334 may have any geometry. The centering rib 336 is provided to center the first guide pin body 302 in the mounting hole 162 in a circuit board 160 (FIG. 4). The centering rib 336 also engages the circuit board material to assist in retaining the first guide pin body 302 in position in the circuit board. The base 320 includes undercut areas 340 which form standoffs 342 that rest on the circuit board 160 (FIG. 4) when the guide pin assembly 300 is installed in the circuit board 160.

The second guide pin body 304 includes an elongated shaft 350 that also extends along the longitudinal axis B. The elongated shaft 350 extends between a tapered end 354 and a base 356 and includes a threaded channel 358 sized to receive the threaded extension 310 on the first guide pin body 302. The base 356 includes a boss 360 that is not keyed. Thus in this embodiment, only the first guide pin body 302 is keyed.

In an alternative embodiment, the second guide pin body 304 can be replaced with an appropriately sized nut to provide a single ended guide pin. In any of the above described embodiments, a thread locking material may be applied to the threads on the fasteners or threaded extensions to inhibit separation of the guide pin bodies or the nut from the guide pin body in applications wherein the circuit boards are subjected to shock or vibration or both.

The embodiments thus described provide a double ended guide pin assembly 120 that is suitable for connecting components, such as daughter cards, to both sides of a circuit board 160. Each guide pin body 140, 144 has a keying surface 172, 198 that is independent of the keying surface on the other guide pin body. The guide pin assembly 120 can be adjusted to accommodate a range of circuit board thicknesses. The guide pin bodies 140, 144 are received in similarly keyed guide modules attached to the daughter cards. The double ended guide pin assembly 120 provides preliminary guidance for the electrical connectors between the circuit boards. The keying features reduce the possibility of damage to the connectors or circuits on the circuit boards being interconnected.

While the invention has been described in terms of various specific embodiments, those skilled in the art will recognize that the invention can be practiced with modification within the spirit and scope of the claims.

What is claimed is:

1. A double ended guide pin assembly comprising:

a first guide pin body having a first rotation axis and a first keying surface;

a second guide pin body having a second rotation axis and a second keying surface; and a fastener element connecting said first guide pin body to said second guide pin body such that said first and second guide pin bodies are independently rotatable on said first and second rotation axes, respectively, said first and second guide pin bodies extending outwardly in a direction generally away from each other, wherein said first and second keying surfaces are selectively positionable at different orientations with respect to each other.

2. The guide pin of claim 1, wherein said first guide pin body comprises an elongated shaft extending along a longitudinal axis between a tapered end and a base, said first guide pin body further including a threaded channel sized to receive an end of said fastener, and said shaft including said first keying surface.

3. The guide pin of claim 1, wherein said second guide pin body comprises an elongated shaft extending along a longitudinal axis between a first end and a base, said second guide pin body further including a through hole extending along said longitudinal axis, and said shaft including said second keying surface.

4. The guide pin of claim 1, wherein said first guide pin body and said second guide pin body each includes a base having a base ring and a keying boss, each said keying boss including a keying protrusion and at least one centering rib, said keying protrusions being configured such that said first and second guide pin bodies may be oriented at different predetermined positions about said common longitudinal axis when installed in a circuit board.

5. The guide pin of claim 1, wherein said first guide pin body and said second guide pin body each includes a base having a base ring and a keying boss, each said base ring including an undercut forming a standoff.

6. The guide pin of claim 1, wherein said first guide pin body and said second guide pin body each includes a base having a base ring and a keying boss, each said keying boss including a keying protrusion that is aligned with a respective one of said first and second keying surfaces.

7. The guide pin of claim 1, wherein said fastener comprises a bolt including a head portion and a shaft portion, said shaft portion being at least partially threaded and received in a through hole in said second guide pin body, and said head portion being tapered.

8. The guide pin of claim 1, wherein said fastener is integrally formed with one of said first and second guide pin bodies.

9. The guide pin of claim 1, wherein said first guide pin body and said second guide pin body each includes a base having a base ring and a keying boss, each said keying boss including a keying protrusion and at least one centering rib, wherein said keying protrusion and said at least one centering rib are formed on a perimeter of said keying boss.

10. A double ended guide pin assembly comprising:

a first guide pin body having a first rotation axis and a first keying surface;

a second guide pin body having a second rotation axis and a second keying surface; and a fastener element connecting said first guide pin body to said second guide pin body such that said first and second guide pin bodies are independently rotatable on said first and second rotation axes, respectively, wherein said first and second keying surfaces are selectively positionable at different orientations with respect to each other, wherein said first and second guide pin bodies are configured to receive a circuit board therebetween and be spaced apart from one another by a variable amount based, in part, on a thickness of the circuit board.

11. A double ended guide pin assembly comprising:

a first guide pin body having a first rotation axis and a first keying surface;

a second guide pin body having a second rotation axis and a second keying surface; and a fastener element connecting said first guide pin body to said second guide pin body such that said first and second guide pin bodies are independently rotatable on said first and second rotation axes, respectively, said first second guide pin bodies extending outwardly in a direction generally away from each other, wherein said first and second keying surfaces are selectively positionable at different orientations with respect to each other; wherein said first guide pin body and said second guide pin body include a space therebetween when joined, said space being variable within a range between a predetermined minimum space and a predetermined maximum space.

12. The guide pin of claim 11, wherein said first guide pin body comprises an elongated shaft extending along a longitudinal axis between a tapered end and a base, said first guide pin body further including a threaded channel sized to receive an end of said fastener, and said shaft including said first keying surface.

13. The guide pin of claim 11, wherein said second guide pin body comprises an elongated shaft extending along a longitudinal axis between a first end and a base, said second guide pin body further including a through hole extending along said longitudinal axis, and said shaft including said second keying surface.

14. The guide pin of claim 11, wherein said first guide pin body and said second guide pin body each includes a base having a base ring and a keying boss, each said keying boss including a keying protrusion and at least one centering rib, said keying protrusions being configured such that said first and second guide pin bodies may be oriented at different predetermined positions about said common longitudinal axis when installed in a circuit board.

15. The guide pin of claim 11, wherein said first guide pin body and said second guide pin body each includes a base having a base ring and a keying boss, each said base ring including an undercut forming a standoff.

16. The guide pin of claim 11, wherein said first guide pin body and said second guide pin body each includes a base having a base ring and a keying boss, each said keying boss including a keying protrusion that is aligned with a respective one of said first and second keying surfaces.

17. The guide pin of claim 11, wherein said fastener comprises a bolt including a head portion and a shaft portion, said shaft portion being at least partially threaded and received in a through hole in said second guide pin body, and said head portion being tapered.

18. The guide pin of claim 11, wherein said fastener is integrally formed with one of said first and second guide pin bodies.

19. The guide pin of claim 11, wherein said first guide pin body and said second guide pin body each includes a base having a base ring and a keying boss, each said keying boss including a keying protrusion and at least one centering rib, wherein said keying protrusion and said at least one centering rib are formed on a perimeter of said keying boss.

20. A double ended guide pin assembly comprising:

a first guide pin body having a first rotation axis and a first keying surface;

a second guide pin body having a second rotation axis and a second keying surface; and a fastener element connecting said first guide pin body to said second guide pin body such that said first and second guide pin bodies are independently rotatable on said first and second rotation axes, respectively, wherein said first and second keying surfaces are selectively positionable at different orientations with respect to each other;

wherein said first guide pin body and said second guide pin body include a space therebetween when joined, said space being variable within a range between a predetermined minimum space and a predetermined maximum space, wherein said first and second guide pin bodies are configured to receive a circuit board therebetween and be spaced apart from one another by the variable amount based, in part, on a thickness of the circuit board.

* * * * *